US010408581B2

(12) United States Patent
Zhou

(10) Patent No.: US 10,408,581 B2
(45) Date of Patent: Sep. 10, 2019

(54) FIRECRACKER AND FIRECRACKER ARRANGEMENT

(71) Applicant: Panda Consumer GmbH, Bad Oldesloe (DE)

(72) Inventor: Peipei Zhou, Husum (DE)

(73) Assignee: Panda Consumer GmbH, Bad Oldesloe (DE)

( * ) Notice: Subject to any disclaimer, the term of this patent is extended or adjusted under 35 U.S.C. 154(b) by 152 days.

(21) Appl. No.: 15/725,631

(22) Filed: Oct. 5, 2017

(65) Prior Publication Data

US 2018/0128582 A1 May 10, 2018

(30) Foreign Application Priority Data

Oct. 5, 2016 (DE) ..... 20 2016 105 535 U

(51) Int. Cl.

| | |
|---|---|
| ***F42B 4/04*** | (2006.01) |
| ***F42B 4/02*** | (2006.01) |
| ***F42B 4/14*** | (2006.01) |
| ***F42B 4/22*** | (2006.01) |

(52) U.S. Cl.

CPC ..... *F42B 4/04* (2013.01); *F42B 4/02* (2013.01); *F42B 4/14* (2013.01); *F42B 4/22* (2013.01)

(58) Field of Classification Search

CPC ..... F42B 4/00; F42B 4/02; F42B 4/04; F42B 4/06; F42B 4/08; F42B 4/10; F42B 4/14; F42B 4/16; F42B 4/22

See application file for complete search history.

(56) References Cited

U.S. PATENT DOCUMENTS

| | | | | |
|---|---|---|---|---|
| 3,744,419 A * | 7/1973 | Hand | F42B 4/22 | 102/360 |
| 4,860,657 A * | 8/1989 | Steinicke | F42B 4/06 | 102/334 |
| 6,244,185 B1 * | 6/2001 | Yip | F42B 4/14 | 102/275.3 |
| 9,506,730 B1 * | 11/2016 | Marietta | F42B 4/14 | |

(Continued)

FOREIGN PATENT DOCUMENTS

| | | | |
|---|---|---|---|
| CH | 535727 A * | 4/1973 | F41A 33/04 |
| DE | 1994333 | 9/1968 | |
| DE | 602005000409 | 8/2007 | |

(Continued)

*Primary Examiner* — Gabriel J. Klein

(74) *Attorney, Agent, or Firm* — Sand, Sebolt & Wernow Co., LPA

(57) ABSTRACT

A firecracker and firecracker arrangement. The firecracker includes an outer sheath having two face sides and that is closed at both face sides with a layer of barrier material. Pyrotechnic effect elements and a bursting charge are arranged inside the outer sheath. A first ignition line that penetrates the barrier material is guided up to the bursting charge. The bursting charge is accommodated inside a completely closed, cylindrical jacket that is arranged coaxial to the outer sheath such that a longitudinal center axes of the outer sheath and of the cylindrical jacket coincide. The first ignition line is guided through an opening in the cylindrical jacket to the bursting charge. The pyrotechnic effect elements are arranged to form a predefined geometric shape in at least one plane extending transverse to the longitudinal center axis of the outer sheath.

21 Claims, 1 Drawing Sheet

(56) References Cited

U.S. PATENT DOCUMENTS

2005/0066837 A1 3/2005 Marietta

FOREIGN PATENT DOCUMENTS

| | | | | | |
|---|---|---|---|---|---|
| DE | 102007054435 | | | 5/2009 | |
| EP | 1 345 004 | | | 9/2003 | |
| EP | 2 669 618 | | | 12/2013 | |
| FR | 1512548 | A | * | 2/1968 | ..... F42B 4/02 |
| FR | 2687218 | A1 | * | 8/1993 | ..... F42B 4/02 |
| GB | 2 338 776 | | | 12/1999 | |

* cited by examiner

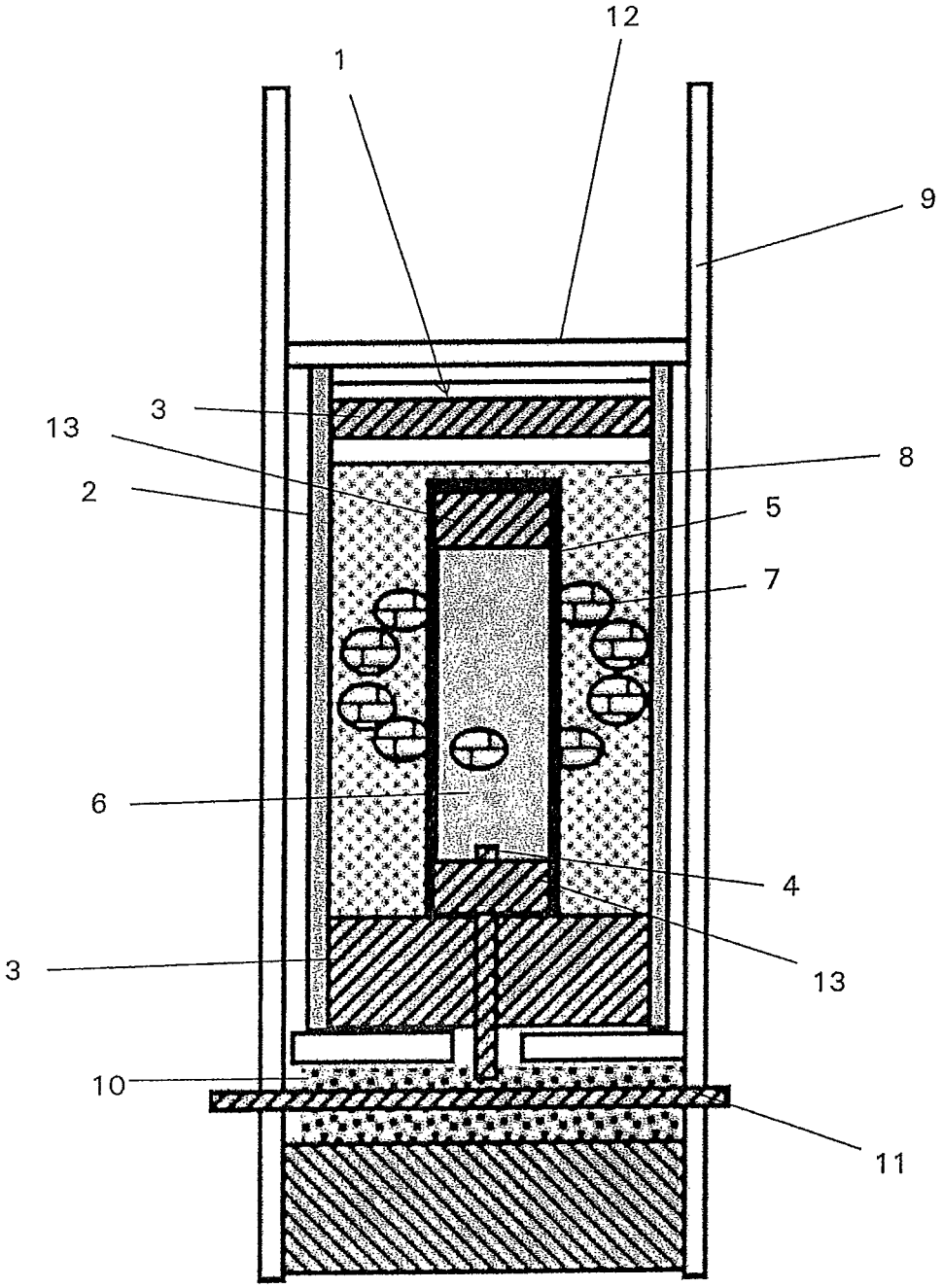
12
1
9
3
13
8
2
5
7
6
4
3
13
10
11

FIRECRACKER AND FIRECRACKER ARRANGEMENT

BACKGROUND

Technical Field

The invention relates to a firecracker having a cylinder casing-type outer sheath having two face sides, which is closed at both of its face sides with a layer of barrier material; a plurality of pyrotechnic effect elements arranged inside the outer sheath; a bursting charge arranged inside the outer sheath for bursting the outer sheath and for scattering the pyrotechnic effect elements and a first ignition line which penetrates the barrier material at a first face side of the two face sides and which is guided up to the bursting charge, characterized in that the bursting charge is accommodated inside a completely closed, cylindrical jacket, with this cylindrical jacket being arranged in a manner coaxial to the outer sheath such that the longitudinal center axes of the outer sheath and of the cylindrical jacket coincide, with the first ignition line being guided through an opening in the cylindrical jacket to the bursting charge, and in that the pyrotechnic effect elements inside the outer sheath and outside the cylindrical jacket between a cylindrical side wall of the cylindrical jacket and a cylindrical side wall of the outer sheath are arranged to form a predefined geometric shape in at least one plane extending transverse, in particular perpendicular, to the longitudinal center axis of the outer sheath. It also relates to a firecracker arrangement with at least one such firecracker.

Background Information

Firecrackers are generally very popular. They are let off at large festive gatherings, such as city festivals, weddings and the like, and in such cases this is often undertaken by professional pyrotechnicians. However, they are also used by individuals, typically at New Year's Eve celebrations and to mark the arrival of the New Year.

There are a variety of different types of firecrackers. They differ from one another on the one hand through the effects produced and on the other hand through categorization with respect to their risk potential or with respect to groups of people who are permitted to use these firecrackers. With respect to the types, it possible to roughly differentiate between firecrackers that produce light effects, firecrackers that produce sound effects (bangs or whistling noises) and firecrackers that produce both effects in combination, in other words, light and sound.

With regards to the risk categorization, the different legal systems provide for various categorizations, with the standard procedure being categorization according to the so-called net explosive mass contained in a firecracker. In Germany, for example, the highest category of firecrackers that can be used by adult individuals, although only at certain times, is the so-called category 2. Category 3 and 4 firecrackers may be set off only by trained pyrotechnicians.

Each discharge of a firecracker tubular battery with bombettes of category 2 may contain a maximum net explosive mass of only 25 g according to the current legislation in Germany. The net explosive mass is constituted by the masses of the different explosive materials which are combined in a firecracker. This includes propellant for launching the firecracker from a launch tube or the like, or for ensuring an ascent into the sky as a firecracker, bursting charges for bursting the firecracker, and pyrotechnic effect elements, which produce the typical colored and/or twinkling light effects.

Conventional elements of category 2 firecrackers are so-called bombettes, which are often brought together in so-called batteries. They are cylindrical firecrackers, which are arranged in receiving tubes of the so-called battery, and which can be launched from the receiving tubes of the battery by means of propellant mounted beneath the bombettes and fired into the sky. These bombettes have on the inside a bursting charge, which bursting charge is set off with a delay, so that the bombette bursts in an explosive manner once a climb height into the sky has been reached, whereby pyrotechnic effect elements contained in the bombette are set off and light effects are produced in the sky. In order that such batteries with bombettes can be classed in the firecracker category 2, such a battery can contain a maximum net explosive mass of only 500 g according to the current German legislation, while the above-mentioned 25 g net explosive mass per firecracker discharge must not be exceeded.

One example of such a battery with bombettes is provided in document DE 10 2007 054 435 A1. In the case of such a bombette known from the prior art or a battery comprising several such bombettes, the pyrotechnic effect elements inside the cylindrical bombette are arranged mixed with the cylinder charge in a random manner. If the bursting charge sets off this bombette in the sky, the pyrotechnic effect elements drift apart from one another in the manner of a cloud and the known cloud-like image produced by the individual, light-effect producing burning-down pyrotechnic effect elements is obtained.

In the case of firecrackers of category 3 and/or 4, in particular in the case of sphere bombs, it is by contrast known that they can be produced in such a way that the pyrotechnic effect elements are accommodated in a prespecified arrangement in the sphere bomb, so that, once the bursting charge is set off, the pyrotechnic effect elements drift apart from one another in a geometric pattern in the sky, for example in a circular shape, a heart shape or even in more complex patterns, such as a so-called smiley for example.

However, it is not yet possible to realize such effects with firecrackers of category 2, in particular with firecracker tubular batteries with bombettes of category 2, in other words, those which are also approved for the end consumer. In particular in the field of bombettes which are much smaller in terms of their external dimensions on the one hand and, in particular, in terms of the net explosive mass used, there are no comparable firecrackers with corresponding effects of the kind that can be achieved in the professional firecracker field with firecrackers of category 3 and/or 4.

SUMMARY

The problem addressed by the invention is accordingly to provide a firecracker which can be designed as a firecracker of category 2, in other words, as a firecracker which can be used by an end user and which, once it has been set off in the sky, allows the pyrotechnic effect elements to drift apart from one another in prespecified geometric patterns and thus trace patterns and shapes in the sky. In particular, such a firecracker should be able to be produced in the form of a so-called bombette. Another problem addressed by the invention is to present a firecracker arrangement with one, in particular with multiple novel firecrackers, so that for example a battery can be formed with bombettes which can produce such lighting-type effects with geometric patterns.

According to the invention, this problem is solved by means of a firecracker having a cylinder casing-type outer sheath having two face sides, which is closed at both of its face sides with a layer of barrier material; a plurality of pyrotechnic effect elements arranged inside the outer sheath; a bursting charge arranged inside the outer sheath for bursting the outer sheath and for scattering the pyrotechnic effect elements and a first ignition line which penetrates the barrier material at a first face side of the two face sides and which is guided up to the bursting charge, characterized in that the bursting charge is accommodated inside a completely closed, cylindrical jacket, with this cylindrical jacket being arranged in a manner coaxial to the outer sheath such that the longitudinal center axes of the outer sheath and of the cylindrical jacket coincide, with the first ignition line being guided through an opening in the cylindrical jacket to the bursting charge, and in that the pyrotechnic effect elements inside the outer sheath and outside the cylindrical jacket between a cylindrical side wall of the cylindrical jacket and a cylindrical side wall of the outer sheath are arranged to form a predefined geometric shape in at least one plane extending transverse, in particular perpendicular, to the longitudinal center axis of the outer sheath. Advantageous further developments of such a firecracker are that the cylindrical jacket is closed at its opposite face sides with a layer of a barrier material; that the pyrotechnic effect elements are arranged in a plane cutting the longitudinal center axis of the cylindrical jacket at the level of the center of the longitudinal extension of the cylindrical jacket in particular at a right angle; and that the pyrotechnic effect elements are arranged in a circle, or heart-shaped or star-shaped. Further developments are that the longitudinal center axis of the cylindrical jacket extends through a geometric center of the at least one geometric shape, which the pyrotechnic effect elements are arranged to form and that the pyrotechnic effect elements inside the outer sheath and outside the cylindrical jacket, between a cylindrical side wall of the cylindrical jacket and a cylindrical side wall of the outer sheath, are arranged to form predefined geometric shapes in at least two planes which are parallel to one another. The firecracker may also include a space between the cylindrical jacket and the outer sheath is filled with a non-explosive filling material, in which the pyrotechnic effect elements are embedded in the predefined geometric arrangement and that the pyrotechnic effect elements are fixed, in particular glued, to an inner side of the cylindrical side wall of the outer sheath. Still further advantageous developments are that the cylindrical jacket is formed from a cardboard material or from a plastic material; that it contains a maximum net explosive mass of 25 g that the outer sheath has a diameter of 14 to 50 mm, in particular of 20 to 40 mm, particularly preferably of 30 mm. A novel firecracker arrangement, which comprises the at least one firecracker according to the invention is also characterized in that the outer sheath has a diameter of 14 to 50 mm, in particular of 20 to 40 mm, particularly preferably of 30 mm. Advantageous further developments of a firecracker arrangement according to the invention on the basis of this invention are include that the firecracker arrangement with at least one tubular receptacle is arranged vertically, and that a firecracker described above is arranged with the first face side adjoining a first end to be oriented facing downwards, with a propellant for launching the firecracker from the tubular receptacle being arranged beneath the first face side at the first end of the firecracker arranged in the tubular receptacle, with a second ignition line being provided for igniting the propellant and for igniting the first ignition line. The firecracker arrangement is further characterized by a plurality of tubular receptacles arranged parallel relative to one another and essentially vertically, in each of which a firecracker is arranged with the first face side facing downwards, with at least one of which firecrackers being formed as disclosed above, and with a propellant being arranged beneath the first face side of each of the firecrackers in each of the tubular receptacles for the launching of the respective firecracker from the respective tubular receptacle, and with the second ignition line for the consecutive ignition of the propellants and for ignition of the respective first ignition line of the respective firecracker being guided in such a way through the firecracker arrangement that this second ignition line ignites the propellants of the tubular receptacles in a sequential manner. The tubular receptacle(s) is/are closed at its/their second end(s) with a sealing closure, such as in particular a sealing plate. The firecracker arrangement is characterized in that it comprises a maximum net explosive mass of 500 g.

According to the invention, a firecracker has—initially in accordance with the known firecrackers according to the prior art—a cylinder casing-like outer sheath having two face sides, which is closed at both of its face sides by means of a layer of barrier material. In a conventional manner, the barrier material can be a plug made of compacted earth material or a clay material or the like.

The firecracker additionally has a plurality of pyrotechnic effect elements arranged inside the outer sheath. These pyrotechnic effect elements can produce many different light effects, in different colors for a start, and also with or without a flash effect or the like. They can in particular also produce light effects which are different from one another, in other words they each shine with different colors or to some extent twinkle or shine in a continuous manner, or the like.

The firecracker additionally has a bursting charge arranged inside the outer sheath for bursting the outer sheath and for scattering the pyrotechnic effect elements. Finally, the firecracker has a first ignition line which penetrates the barrier material at a first face side of the two face sides and which is guided up to the bursting charge. This first ignition line serves for an—in particular delayed—ignition of the bursting charge, and in particular when the firecracker is fired into the sky with a propellant, this first ignition line is dimensioned with respect to its time delay such that the bursting charge only ignites once a predetermined climb height of the firecracker has been reached, so that the pyrotechnic light effect, produced by the pyrotechnic effect elements, is obtained at an adequate height in the sky.

What makes the firecracker according to the invention special is that the bursting charge is accommodated inside a completely closed cylindrical jacket, with this cylindrical jacket being arranged in a manner coaxial to the outer sheath such that the longitudinal center axes of the outer sheath and of the cylindrical jacket coincide. The coincidence of the longitudinal center axes must not occur in an exact manner on one and the same line, but rather, an approximate coincidence of these longitudinal center axes is sufficient, so that the cylindrical jacket, in which the bursting charge is accommodated, is arranged relative to the orientation transverse to the longitudinal direction essentially centrally on the inside of the cylinder casing-like outer sheath.

By contrast with known firecrackers, in which bursting charges are either introduced without additional casing and mixed together with the pyrotechnic effect elements into a receptacle enclosing the firecracker, for example a cylinder casing-like outer sheath, or in which bursting charges are arranged in the firecracker loosely and not in an exactly determined manner with respect to the geometric shape filled in a kind of paper bag, a defined cylindrical jacket is formed in the case of the firecracker according to the invention, which cylindrical jacket contains the bursting charge. So that the bursting charge can be ignited, the first line is guided through an opening in the jacket to the bursting charge. This is necessary in particular because the wall of the cylindrical jacket does not for example catch the ignition spark and burn so that the bursting charge is directly ignited. Instead, compared with the known paper bags the wall of the cylindrical jacket is much stiffer and more dimensionally stable, so that the cylindrical jacket retains its cylindrical form. This is achieved by means of stronger wall materials, which is not penetrated by a spark from the ignition line.

The invention furthermore envisages that the pyrotechnic effect elements inside the sheath and outside the cylindrical jacket, in other words, outside the bursting charge, between a cylindrical side wall of the cylindrical jacket and a cylindrical side wall of the outer sheath, are arranged to form a predefined geometric shape in at least one plane extending transverse, in particular perpendicular, to the longitudinal center axis of the outer sheath. The geometric shape, which the pyrotechnic effect elements are arranged to form, then defines the shape or the symbol which will be traced in the sky with the drifting apart, burning down effect elements once the bursting charge has been ignited. Very different geometric shapes can be envisaged here, with simple geometric shapes, such as circles, hearts or stars for example being particularly suitable due to the fundamentally restricted space. If the pyrotechnic effect elements are arranged for example in a circular shape in a plane which extends oriented transverse, in particular perpendicular to the longitudinal center axis of the cylindrical jacket, inside which the bursting charge is arranged, then effect elements are very precisely driven uniformly outwards following ignition of the bursting charge due to the predetermined geometry of their arrangement on the one hand and due to the predetermined geometry, in which the bursting charge is arranged in the cylindrical jacket on the other hand, so that the circular shape is retained even when the pyrotechnic effect elements are scattered and burn down. A bright growing circle will thus be visible in the sky.

What makes the invention special is that, by means of the arrangement of the bursting charge in a cylindrical jacket with a clearly defined geometry, even in a restricted space and with a limited amount of net explosive mass of the bursting charge, a defined and precise scattering of the pyrotechnic effect elements from the original geometric arrangement to geometric patterns which have increasing diameters but which retain the precise geometric alignment can be achieved in the sky. For the first time, this makes it possible to also realize such effects in class 2 firecrackers that are suitable for consumers. The consumer thus hereby gains access to pyrotechnic effect firecrackers, which could previously be obtained only at fireworks displays professionally set off by pyrotechnicians. The consumer therefore enjoys significant additional benefits when he sets off such a firecracker with such firecrackers.

The cylindrical jacket can advantageously be closed at its opposite face sides by means of a layer of a barrier material. This ensures that a pressure pulse, which is generated when the bursting charge is ignited, does not escape for example axially via the face sides of the cylindrical jacket, but occurs directed radial, so that the pyrotechnic effect elements arranged in the predetermined geometric shape are uniformly scattered radially with maximum impetus.

In particular when pyrotechnic effect elements are arranged to form geometric arrangements in the firecracker according to the invention in only one plane or in an odd number of planes, it is advantageous that these pyrotechnic effect elements are arranged in a plane cutting the longitudinal center axis of the cylindrical jacket at the level of the center of the longitudinal extension of the cylindrical jacket, in particular at a right angle. Because in such a central section of the bursting charge, which is held in the geometric shape by means of the cylindrical jacket, the explosive burning of said bursting charge applies a particularly uniform pulse in the radial outwards direction to the effect elements, so that they retain, in a very uniform manner, the desired geometric shape in the sky when they drift apart.

The shape traced with the burning-down pyrotechnic effect elements develops in a particularly uniform manner after ignition of the bursting charge even when, as provided for according to an advantageous further development of the invention, the longitudinal center axis of the cylindrical jacket extends through a geometric center of the at least one geometric shape, which the pyrotechnic effect elements are arranged to form.

As already indicated above, the firecracker according to the invention is not limited such that only a single geometric shape can be produced with said firecracker. Instead, the pyrotechnic effect elements can also be arranged in two or more planes and can be placed in shapes in each of the planes according to a predetermined geometric arrangement. These shapes can for example be similar shapes, such as two or more circles for example. Different shapes can however also be provided, for example a circle and a star or the like. If the bursting charge is ignited, then several geometric shapes arranged in parallel planes relative to one another can then be seen in the sky.

It is in principle also possible to arrange several burster arrangements in consecutive compartments in the other sheath, so that—in a continued manner via an additional ignition line—with delayed ignition two or even more shapes of a geometric type are traced in the sky one after the other, when the separated bursting charges ignite one after the other and in each case scatter at least one geometric arrangement of pyrotechnic effect elements of the predefined geometric shape and thus trace in the sky a circle, a star or a heart for example.

In order to place and to fix the pyrotechnic effect elements in the predefined geometric arrangement in the firecracker, they can for example be embedded in a non-explosive filling material, such as sand for example, which is made to fill a space between the cylindrical jacket and the outer sheath. Other options for fixing the pyrotechnic effect elements in the desired geometric arrangement are also conceivable however. They can for example, as envisaged in another variant of the invention, be fixed, for example glued, to an inner side of the cylindrical side wall of the outer sheath, in addition to or alternatively to the embedding in the non-explosive filling material. The only essential thing is that the geometric arrangement of the pyrotechnic effect elements is not lost either during transportation of the firecracker according to the invention or during the launching thereof from a receiving tube and firing into the sky, so that they are still in this geometric arrangement when the bursting charge is ignited and trace a corresponding symbol in the sky.

The cylindrical jacket can in particular be formed from a cardboard material or from a plastic material. The critical factor is that the wall thickness of the cylindrical jacket is sufficient so that this jacket, once filled with the bursting charge, keeps said bursting charge in the cylinder form defined by the cylindrical jacket. The ignition line for the supply of an ignition spark for the ignition of the bursting charge is guided in particular by means of a face-side wall of the cylindrical jacket.

As stated above, the objective of the invention is that the firecracker should belong to the so-called category 2, in other words, a firecracker that can be freely purchased by end consumers who are of age. Accordingly, the firecracker according to the invention advantageously contains a maximum of 25 g net explosive mass, and in the case of a battery a maximum of 25 g net explosive mass per discharge, with said value being selected in accordance with the current limit value for firecrackers of category 2 according to the German legislation. For other countries or in the case of appropriate legislative amendments, a different upper limit should be preferred; it should namely always be one which is maximally permissive for a use by the end consumer. Of course, if this upper limit cannot be exceeded, the firecracker according to the invention can also be fitted with less net explosive mass.

The firecracker according to the invention is advantageously formed as a so-called bombette, with said firecracker typically having a diameter of 8 to 30 mm, in particular of 18 to 30 mm, particularly preferably of 30 mm.

Another component of the invention is a firecracker arrangement with at least one tubular receptacle to be arranged vertically, in which a firecracker of the type described above is arranged with the first face side, in other words, that face side which is penetrated by the ignition line, adjoining a first end which is to be oriented facing downwards, with a propellant for launching the firecracker from the tubular receptacle being arranged beneath the first face side at the first end of the firecracker arranged in the tubular receptacle, and with a second ignition line for igniting the propellant and for lighting the first ignition line being provided. With such a firecracker arrangement, the firecracker according to the invention can be fired into the sky, where it then traces in the sky, by means of ignition of the bursting charge, the graphic symbol or the geometric shape with the burning-down pyrotechnic effect elements as a light symbol. It should in particular be understood that the propellant can be arranged on the one hand separated from the firecracker in the tubular receptacle, but can on the other hand also be arranged as a component of the firecracker. In this regard a firecracker according to the invention can also have its own propellant. The first and the second ignition line can be separated ignition lines, however the second ignition line can also be connected to the first feed lines in such a way that it continues to burn, with a burnt section of the second ignition line being detached from the first ignition line following the burning down and ignition of the propellant, so that the firecracker can climb into the sky, without being held back for example by a burned down ignition line.

The firecracker arrangement can in particular be formed in the manner of a battery, i.e. with a plurality of tubular receptacles arranged parallel relative to one another and essentially vertically, in each of which a firecracker is arranged, in particular a firecracker of the type described above, with a propellant being arranged under the first face side of each of the firecrackers in each of the tubular receptacles for the launching of the respective firecracker from the tubular receptacle, and with the second ignition line being guided in such a way through the firecracker arrangement for the purpose of consecutive ignition of the propellants and for ignition of the respective first ignition line of the respective firecracker that this second ignition line ignites the propellants of the tubular receptacles in a sequential manner. In such a so-called battery all of the firecrackers can be formed in the manner described above, so that all firecrackers fired therefrom trace geometric patterns in the sky. However, it is also possible for a smaller number of the firecrackers according to the invention to be arranged in the battery mixed with conventional firecrackers, so that for example geometric shapes and cloud-like arrangements of burning-down effect elements can be seen in an alternating manner in the sky, when the battery is ignited.

In particular, the tubular receptacle or the tubular receptacles can be closed at its/their second end(s) with a closure, such as in particular a sealing plate. Such plates are typically formed from board or plastic and in particular ensure that the receiving tube is sealed, and that the firecracker cannot fall out or be removed in an unauthorized manner.

In order to also keep such a battery in category 2 of firecrackers, in other words, suitable for end consumers, according to the currently applicable provisions in the EU, in other words, in Germany also, it should comprise a maximum net explosive mass of 500 g. For other countries or in the case of an amendment to the regulations in Germany, the maximum net explosive mass value must be adapted accordingly.

From such so-called batteries, it is also possible to form so-called composite batteries, with said composite batteries being able to contain a maximum of 2 kg net explosive mass in accordance with the current provisions for firecrackers of category 2 in Germany. Here too, the individual batteries to be combined in the composite battery cannot exceed a net explosive mass of 500 g in each case.

References to "cylindrical" or "cylinder shape" in the above text relate in particular to the shape of a circular cylinder.

BRIEF DESCRIPTION OF THE SEVERAL VIEWS OF THE DRAWINGS

Additional advantages and features of the invention will emerge from the following description of an exemplary embodiment with reference to the attached FIGURE, in which single FIGURE:

FIG. 1 shows a schematic longitudinal sectional depiction through an arrangement of a firecracker according to the invention in a receiving tube fitted with a propellant.

The single FIG. 1 illustrates, in a highly schematic depiction, an exemplary embodiment according to the invention of a firecracker and a firecracker arrangement according to the invention.

DETAILED DESCRIPTION

A firecracker 1 according to the invention is formed here in the form of a so-called bombette. It has an outer cylindrical sheath 2, which is in particular formed from a paper or cardboard material with a stable wall thickness. At the face side, this sheath 2 is closed in each case by means of a layer of barrier material 3. A first ignition line 4 is passed through the layer of barrier material 3 depicted at the bottom in FIG. 1 and projects outwards from the firecracker 1. A bursting charge 6 made from an explosive material is arranged in a cylindrical jacket 5, which is constructed in a dimensionally stable manner and which can in particular be formed from a cardboard material or plastic material. The cylindrical jacket 5 is closed at each of its face sides with a layer of a barrier material 13. This can be the same barrier material as the barrier material 3 which closes the firecracker 1 at the face side. The face side closure of the cylindrical jacket 5 ensures that the pressure pulse obtained by the ignition of the bursting charge 6 acts in a radial manner and is not dissipated axially via the face sides. The first ignition line 4 is guided through a face side of the cylindrical jacket 5 arranged at the bottom in FIG. 1 and through the barrier material 13 arranged there until it is introduced into the bursting charge 6.

The cylindrical jacket 5 with the bursting charge 6 arranged therein is oriented coaxial to the outer sheath 2 and is situated, when viewed transverse to the longitudinal direction, arranged centrally therein. That means that the longitudinal center axis of the outer sheath 2 and the longitudinal center axis of the cylindrical jacket 5 lie on one another in a substantially coincidental manner. In an annular space between the casing wall of the cylindrical jacket 5 and the outer cylindrical sheath 2 pyrotechnic effect elements 7 are arranged in a predetermined geometric shape, which in this case is circular. The pyrotechnic effect elements 7 lie in a plane—in this case a single plane, which here extends oriented perpendicular to the longitudinal center axis of the cylindrical jacket and cuts through the latter approximately centrally. A tipped-out depiction of the pyrotechnic effect elements 7 arranged in a circle is selected here solely for the purpose of illustration so as to show said pyrotechnic effect elements in their geometric arrangement.

The number of pyrotechnic effect elements 7 depicted here does not necessarily correspond to the number of effect elements 7 arranged in the firecracker 1. The pyrotechnic effect elements 7 are embedded in a non-explosive filling material 8, for example, sand. By this means they are held in the set form and alignment relative to one another. As can be seen, the pyrotechnic effect elements 7 are here arranged in a circular shape and in a concentric manner about the cylindrical jacket 5.

The firecracker 1 is arranged in a receiving tube 9, which can for example be a receiving tube 9 of a battery of firecrackers 1, with said receiving tube 9 extending vertically and a propellant 10 being arranged beneath the firecracker 1. A second ignition line 11 is guided through this propellant, with the first feed line 4 being brought close to said second ignition line with its end projecting from the firecracker 1. A sealing plate 12 closes the receiving point 9 above the firecracker 1 at the face side.

To ignite the firecracker 10 the second ignition line 11 is ignited. Said ignition line burns down until it reaches the propellant 10, which is thus ignited. As a result of ignition of the propellant 10, the firecracker 1 is launched from the receiving tube 9 in the vertical direction and climbs into the sky. At the same time, when the propellant 10 is ignited, the end of the first ignition line 4 projecting from the firecracker 1 is ignited and burns through the layer of barrier material 3 depicted at the bottom in FIG. 1 and through the cylindrical jacket 5 until the bursting charge 6 is reached. The bursting charge 6 is thus ignited and breaks though the outer cylindrical sheath 2 and scatters the pyrotechnic effect elements 7 in a defined manner with a pulse which is essentially the same in terms of amount and which is directed radially outwards, so that a growing circle is produced in the sky as a pyrotechnic luminous geometric symbol. The delay between the ignition of the propellant 10 and the ignition of the bursting charge 6, which is determined by the configuration of the first ignition line 4, is selected such that the bursting charge 6 is ignited only once a predetermined climb height of the firecracker 1 is reached.

The special feature of the arrangement of the bursting charge 6 in the cylindrical jacket 5 makes it possible to here arrange a corresponding accurately-formed geometric shape with the pyrotechnic effect elements 7 in a very small space in the firecracker and then in the sky. This applies in particular also to a bombette of category 2, in other words, with a maximum net explosive mass of 25 g for the discharge. The depicted bombette can for example have a diameter of the outer sheath 2 of 20 to 30 mm, in particular 30 mm.

The exemplary embodiment depicted here does not limit the invention, which is defined by the claims below.

LIST OF REFERENCE NUMERALS

1 firecracker
2 outer cylinder casing-type sheath
3 barrier material
4 first ignition line
5 cylindrical jacket
6 bursting charge
7 pyrotechnic effect element
8 filling material
9 receiving tube
10 propellant
11 second ignition line
12 sealing plate
13 barrier material

The invention claimed is:

1. A firecracker comprising:

a cylindrical outer sheath having two face sides, which is closed at both of the outer sheath's face sides with a layer of barrier material;

a plurality of pyrotechnic effect elements arranged inside the outer sheath;

a bursting charge arranged inside the outer sheath for bursting the outer sheath and for scattering the pyrotechnic effect elements; and a first ignition line which penetrates the barrier material at a first face side of the two face sides and which is guided up to the bursting charge;

wherein the bursting charge is accommodated inside a completely closed, cylindrical jacket, with the cylindrical jacket being arranged in a manner coaxial to the outer sheath such that a longitudinal center axes of the outer sheath and of the cylindrical jacket coincide, with the first ignition line being guided through an opening in the cylindrical jacket to the bursting charge, and in that the pyrotechnic effect elements are inside the outer sheath and outside the cylindrical jacket between a cylindrical side wall of the cylindrical jacket and a cylindrical side wall of the outer sheath and are arranged to form a predefined geometric shape in at least one plane extending transverse to the longitudinal center axis of the outer sheath.

2. The firecracker according to claim 1, wherein the cylindrical jacket is closed at the cylindrical jacket's opposite face sides with a layer of a barrier material.

3. The firecracker according to claim 1, wherein the pyrotechnic effect elements are arranged in a plane cutting the longitudinal center axis of the cylindrical jacket at a level of a center of the longitudinal extension of the cylindrical jacket.

4. The firecracker according claim 3, wherein the longitudinal center axis of the cylindrical jacket extends through a geometric center of the predefined geometric shape, which the pyrotechnic effect elements are arranged to form.

5. The firecracker according to claim 3, wherein the pyrotechnic effect elements are arranged in the plane cutting the longitudinal center axis of the cylindrical jacket at the level of the center of the longitudinal extension of the cylindrical jacket at a right angle.

6. The firecracker according claim 1, wherein the pyrotechnic effect elements are arranged in a circle, or a heart-shape or a star-shape.

7. The firecracker according to claim 1, wherein the pyrotechnic effect elements inside the outer sheath and outside the cylindrical jacket, between the cylindrical side wall of the cylindrical jacket and the cylindrical side wall of the outer sheath, are arranged to form predefined geometric shapes in at least two planes which are parallel to one another.

8. The firecracker according to claim 1 wherein a space is defined between the cylindrical jacket and the outer sheath and the space is filled with a non-explosive filling material, and the pyrotechnic effect elements are embedded in the non-explosive filling material in the predefined geometric arrangement.

9. The firecracker according to claim 1, wherein the pyrotechnic effect elements are fixed, to an inner side of the cylindrical side wall of the outer sheath.

10. The firecracker according to claim 9, wherein the pyrotechnic effect elements are glued to an inner side of the cylindrical side wall of the outer sheath.

11. The firecracker according claim 1, wherein the cylindrical jacket is formed from a cardboard material or from a plastic material.

12. The firecracker according to claim 1, wherein the firecracker contains a maximum net explosive mass of 25 g.

13. The firecracker according to claim 1, wherein the outer sheath has a diameter of 14 to 50 mm.

14. The firecracker according to claim 13, wherein the outer sheath has a diameter of 20 to 40 mm.

15. The firecracker according to claim 14, wherein the outer sheath has a diameter of 30 mm.

16. A firecracker arrangement with at least one tubular receptacle to be arranged vertically, in which a firecracker according to claim 1 is arranged with the first face side adjoining a first end of the firecracker and orientable facing downwards, with a propellant for launching the firecracker from the at least one tubular receptacle arranged beneath the first face side at the first end of the firecracker and wherein the firecracker is arranged in the at least one tubular receptacle with a second ignition line being provided for igniting the propellant and for igniting the first ignition line.

17. The firecracker arrangement according to claim 16, wherein the at least one tubular receptacle comprises a plurality of tubular receptacles arranged parallel relative to one another and essentially vertically, wherein in each of the plurality of tubular receptacles a firecracker is arranged with the first face side facing downwards, and with a propellant being arranged beneath the first face side of each of the firecrackers in each of the plurality of tubular receptacles for the launching of the respective firecracker from the respective tubular receptacle, and with a second ignition line for the consecutive ignition of a propellants and for ignition of the respective first ignition line of a respective firecracker being guided in such a way through the firecracker arrangement that the second ignition line ignites the propellants of the plurality of tubular receptacles in a sequential manner.

18. The firecracker arrangement according to claim 17, wherein the at least one tubular receptacle is closed at a second end with a sealing closure.

19. The firecracker arrangement according to claim 18, wherein the at least one tubular receptacle is closed at the second end with a sealing plate.

20. The firecracker arrangement according to claim 16 having a maximum net explosive mass of 500 g.

21. The firecracker according to claim 1, wherein the pyrotechnic effect elements inside the outer sheath and outside the cylindrical jacket between the cylindrical side wall of the cylindrical jacket and the cylindrical side wall of the outer sheath are arranged to form a predefined geometric shape in at least one plane extending perpendicular to the longitudinal center axis of the outer sheath.

* * * * *